United States Patent [19]

Fawcett

[11] 3,940,130

[45] Feb. 24, 1976

[54] BULL FIGHTING GAME

[76] Inventor: William F. Fawcett, 1839 Port Seabourne Way, Newport Beach, Calif. 92660

[22] Filed: Oct. 3, 1974

[21] Appl. No.: 511,785

[52] U.S. Cl. ..... 273/1 E; 273/85 R

[51] Int. Cl.[2] ..... A63B 67/00

[58] Field of Search ..... 273/1 E, 1 R, 85 R, 85 A, 273/85 B, 85 F, 86 R, 86 B, 89, 91, 105.2; 272/1 R; 35/8 A, 29 R

[56] References Cited

UNITED STATES PATENTS

| | | | |
|---|---|---|---|
| 2,464,261 | 2/1949 | Ripley | 273/85 F |
| 2,479,354 | 8/1949 | Hanson | 273/105.2 X |
| 2,819,900 | 1/1958 | Brackett | 273/85 F X |
| 2,917,310 | 12/1959 | Durrell | 273/85 |
| 3,546,696 | 12/1970 | Waters et al. | 273/86 B |
| 3,586,331 | 6/1971 | Tickell | 273/105.2 X |
| 3,776,553 | 12/1973 | Kelton | 273/105.2 |
| 3,802,706 | 4/1974 | Hamm | 273/105.2 |

*Primary Examiner*—Richard C. Pinkham
*Assistant Examiner*—William R. Browne

[57] ABSTRACT

This specification discloses a bull fighting game comprising a bull that is electromechanically controlled to simulate certain animal movements associated with a bull similar to that in a bull ring. The bull is moved in a circular tracked arrangement having a carriage thereon with support appendages therefrom for supporting the bull. A participant stands on a central circular area that provides a safety switch for interlocking the entire system. The participant passes a cape or an electronically sensitive device over the bull to generate an output consistent with the quality of the passage of the cape by the participant. The bull moves through a various series of programmed moves for purposes of simulating the passage of the bull. A control computer controls the activity of the bull and creates the movements in response to a pre-established program, and the appendages of the bull are driven by actuators.

12 Claims, 8 Drawing Figures

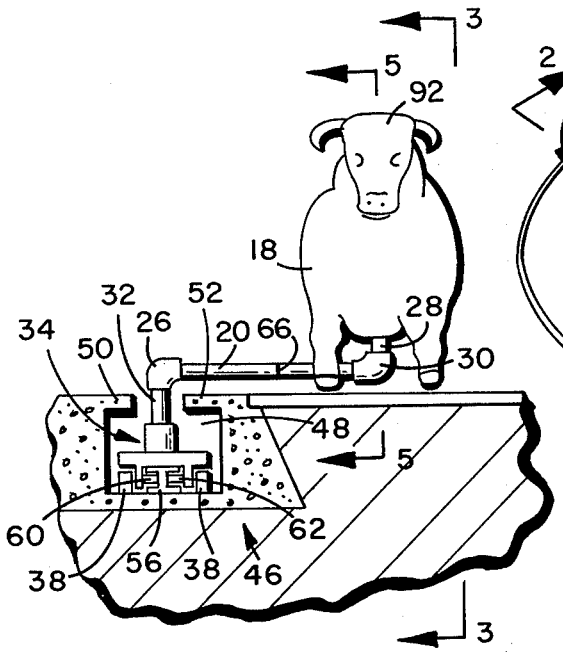
FIG. 2
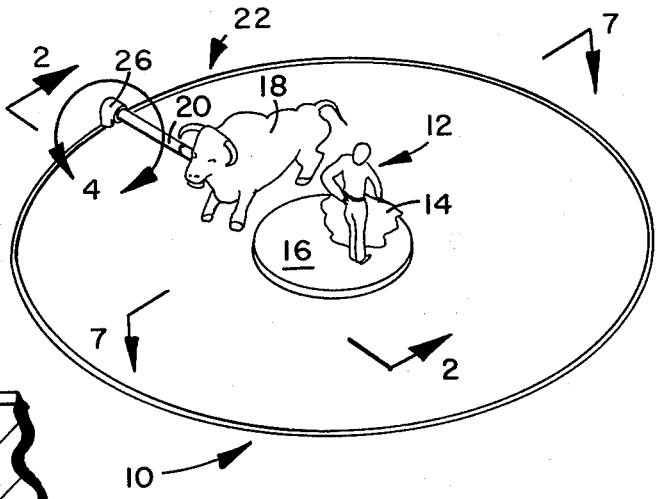
FIG. 1
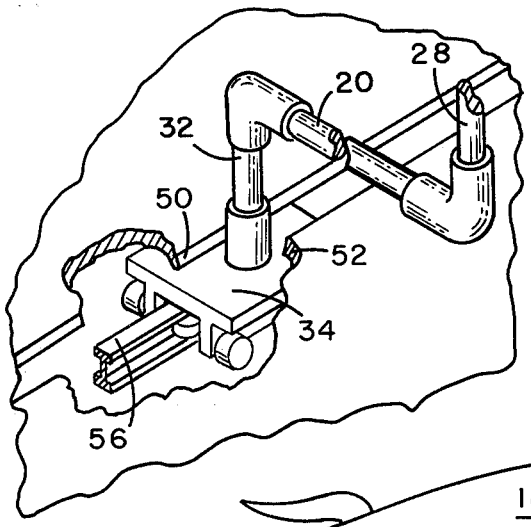
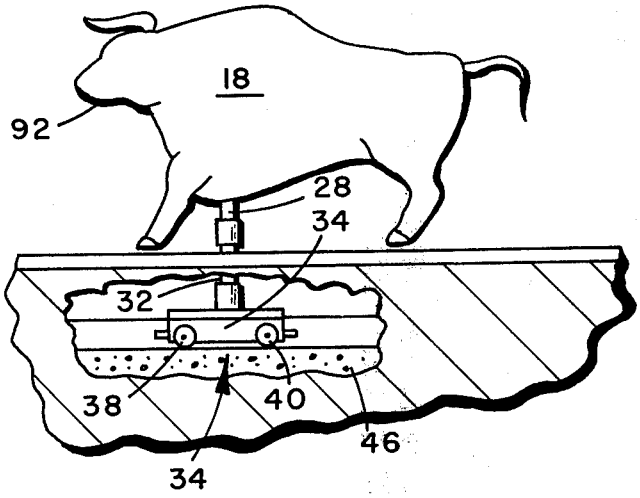
FIG. 3
FIG. 4
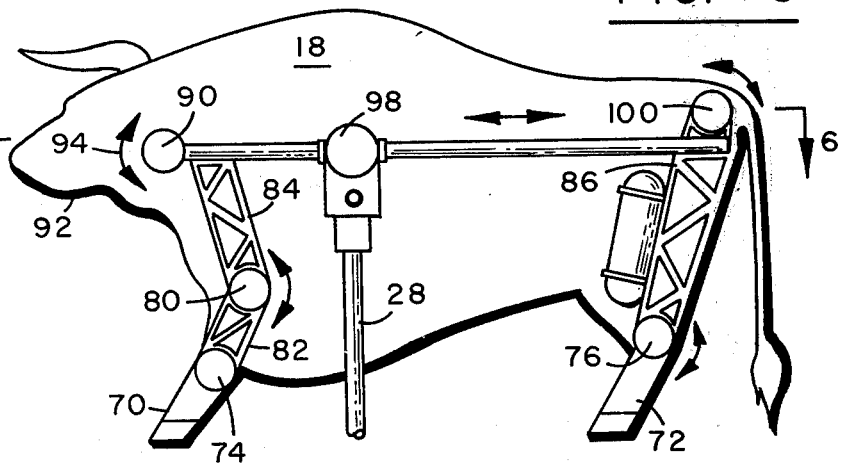
FIG. 5

BULL FIGHTING GAME

BACKGROUND OF THE INVENTION

1. Field of the Invention

The field of this invention is within the toys and games art. Specifically, it relates to human participation on a scale equivalent to an actual participant in a bull ring by virtue of a mechanically operated and electronically controlled bull and a participant's activity with respect to making cape passes with respect to the bull.

2. The Prior Art

The prior art shows games which are hand operated. Such small scale games are not consistent with player participation in a simulated real life situation.

Many of the prior art games incorporating life-size participation do not provide authenticity to a participant. As can be appreciated, it is difficult to provide authenticity to a participant in many games, in a real life sense of the word, without substantial danger.

This game is designed to avoid the dangers inherent to a participant if he incurred a real life situation. The invention allows a participant to incur a fully-simulated bull fight without the inherent dangers of actually passing a cape by a real bull.

Many games of the prior art did not provide the excitement, facility, and capability of providing a realistic enjoyable experience to a participant. It can be appreciated that there are certain rides in amusement parks that a participant enjoys, such as bumper cars and motorboat rides, wherein the participant has full participation. Furthermore, there are games such as ball throwing games and certain contests wherein the participant tests his skill.

However, it is believed that this invention is one of the first real life simulated games of its type wherein the participant enjoys the effects of his activity in a game of skill. In this particular invention, the participant responds with respect to simulated movements of a bull upon which the participant is to score. The score is maintained in a manner whereby the participant has an actual appreciation of his skill with respect to that which it would be in a real life situation. The score is maintained and fed back to provide simulated sound effects in adjacent relationship to the participant. For example, the participant receives either an ovation in the form of a Spanish Ole or a Boo as to the quality of his pass as recorded by a computer.

It is believed that there is no other game in the prior art incorporating the facilities of a real-life bull fight and scoring capability as provided by the instant invention. As a consequence, the invention is an exciting and innovative attraction that simulates actual bull fighting conditions. The invention can be utilized in a number of various configurations including the preferred embodiment as shown.

The movement of the bull can vary from its basic pattern in a random manner which is equivalent to the movement that a bull would normally make during his charging activity.

The invention incorporates safety interlocks such that the participant is protected within a certain area from damage by the charging bull. If the participant moves away from the area, a safety interlock stops the movement of the bull. As a consequence, this invention is a substantial improvement over the prior art by providing a realistic, simulated bull fight to a participant where the ability to score and have simulated surroundings is provided with safety.

SUMMARY OF THE INVENTION

In summation, this invention comprises a bull fighting game which has a substantial degree of real life similarity thereto.

More specifically, the invention provides a bull fighting game with the participant standing in the middle of a ring wherein a bull passes by the participant. The participant stands on a trip switch plate which interlocks the entire system with regard to movement of the bull. Thus, if the participant moves from the area of safety, affected by the interlock, the entire system stops and the participant will not be hurt by the movement of the bull.

The bull moves in a pre-established manner through a series of sequenced patterns in either a selected or random manner. As the bull moves, it is caused to make simulated body and charging movements. The participant passes a cape which can be electronically interfaced with the head of the bull or mechanically interfaced so that the passage of the cape is recorded. The passage of the cape as to its quality and placement can be recorded with regard to points and an environment provided in the form of cheers or nugatory comments.

The bull is caused to move in an annular orientation by means of a supporting arm that is on a track. The supporting arm can be moved with regard to its angle and elevation so as to cause the bull to move in any sort of arcuate or straight path in response to the direction desired and pre-established program of the computer.

The appendages of the bull are driven by pneumatic, hydraulic, or electromechanical devices in response to computer commands.

The details and other aspects of this invention will become apparent to one skilled in the art by a reading of the following specification.

BRIEF DESCRIPTION OF THE DRAWINGS

The invention will be more clearly understood by reference to the description below taken in conjunction with the accompanying drawings wherein:

FIG. 1 shows a perspective plan view of the game of this invention wherein a bull is passing a person, simulating a matador with a cape, in a bull ring;

FIG. 2 shows a frontal elevation view (partially sectioned) of the bull and the device upon which it is supported in the direction of lines 2—2 of FIG. 1.

FIG. 3 shows a (partially sectioned) side elevation view of the bull and its support means in the direction of lines 3—3 of FIG. 2;

FIG. 4 shows a fragmented view of the support means of the bull as enclosed within the circle 4 of FIG. 1;

FIG. 5 shows a schematic sectioned view of the control elements of the bull as sectioned in the direction of lines 5—5 of FIG. 2;

DESCRIPTION OF THE PREFERRED EMBODIMENTS

Figure 6:
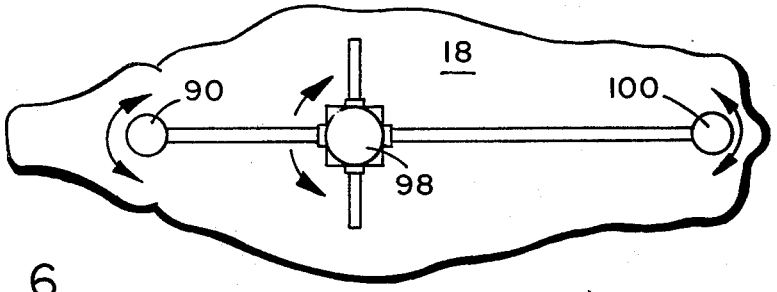
FIG. 6 shows a plan view of some of the operative components of the bull as seen along lines 6—6 of FIG. 5.

Looking more particularly at the figures, it can be seen in FIG. 1 that a simulated ring 10 for a matador and a bull is shown. The ring 10 is provided with a wall, a series of boards, or any other suitable means to effectuate a simulated bull ring. Within the bull ring 10 a participant 12 is shown with a cape 14. The participant 12, of course, is playing the part of a matador. The participant 12 stands upon a disc 16 which is utilized to trigger an interlock of the operating controls of this invention.

Passing by the matador or participant 12 is a bull 18 on a cantilevered bar 20. The cantilevered bar 20 is placed within a track 22 so that it can rotationally move around the track 22. The bar 20 is supported by means of a fixture 26 which shall be detailed hereinafter with respect to the drive and the various components of this invention.

Looking more specifically at FIG. 2, it can be seen that the bull 18 is supported by not only the bar 20, but an upright rod 28 joined by an elbow 30. The connecting linkage 26 is secured to a second upright 32 that forms a portion of a travelling carriage 34.

The travelling carriage 34 incorporates a pair of wheels at the front and the rear, namely wheels 38 and 40. The wheels 38 and 40 are made of any suitable material such as metal, or can be made of a resilient rubber type of material to cushion the carriage 34 so that it moves smoothly over its underlying surface. The track 22 can be formed by a cast concrete channel 46. The cast concrete channel has a passageway 48 with two overriding flanges 50 and 52. The overriding flanges 50 and 52 serve to protect the interior of the track and prevent any unwarranted entry of foreign objects thereinto.

The wheels 38 can be supported on the bottom surface of the concrete channel 46 and are guided by means of an I bar rail 56. The I bar rail 56 incorporates rollers 60 and 62 which travel adjacent to the upright portion of the I of the I bar. The rollers 60 and 62 enable the carriage 34 to support itself against the transverse portion of the I bar when there are substantial cantilevered loads on the arm or bar 20. The arm or bar 20 can be of a telescopic type so that it can move inwardly and outwardly. In this particular embodiment the telescoping feature has not been detailed, but for purposes of explanation, it can be seen that the bar is joined at point 66 so that one portion telescopes over the other in an inward and outward manner, in the same manner as a ladder used on a fire truck.

The carriage 34 is such, that it can be chain driven by a chain which is not shown, or it can be driven by an electric motor within the housing of the carrige 34. When driven by an electric motor within the housing, it causes the wheels to turn by any suitable means. The electrical connection between the carriage 34 can be made through the rail 36 or by means of a lead to the carriage 34, which is not shown. The control of the motor driving the wheels 38 and 40 can be effectuated by a remote controller. Also, the drive on the wheels 38 and 40 can be provided on a constant basis with any suitable control as previously mentioned or by means of an electrical connection between the I bar rail or through a lead or other contact.

The bull 18 is caused to move in a circular manner around the track 22. As it moves, it provides a simulated appearance of running by means of front legs 70 and rear legs 72 being actuated in a forward and backward direction by respective actuators 74 and 76. The actuators 74 and 76 can be pneumatically, hydraulically, or electrically controlled. They provide any suitable function as dictated by the control computer of this invention.

The movement of the legs can also be in a constant manner, back and forth, so that the pivotal action of the actuators 74 and 76 is on a constant basis. This can be effectuated through any drive means within the bull 18 such as a rotational drive motor, crank, and cam to effectuate a forward and backward movement of the legs 70 and 72.

In addition to the foregoing movement of legs 70 and 72, the other portion of the legs can be moved by means of an actuator 80 at a pivotal point thereat. The actuator 80 can enhance the movement of the upper and lower portion of the legs as defined by the lower portion of the legs 70 and the upper portion 82. The upper portion 82 is fundamentally a structural member that can be made of any suitable structural material, such as the steel cross members as shown. The structural portion of the bull is shown with an upper structural member 84 attached to the legs 70 and an upper structural member 86 attached to the legs 72. The structural members 84 and 86 provide the structure to allow the bull to move its legs as provided by actuators 74, 76 and 80.

In addition to the foregoing movement an actuator 90 is uiliized for causing the movement of a head 92 of the bull. The head 92 can move up and down so as to create a tossing type of movement which is tantamount to the movement of a bull's head during its charge when it tries to toss its prey.

The actuator 90 can be controlled by the control computer which controls the remainder of the bull 18.

The actuator 90 is not only used for allowing the head of the bull to go in an upward and downward direction as indicated by an arrow 94, but also can be utilized to provide a lateral movement so that the bull's head moves to either side. Regardless of how the head of the bull moves, it should be understood that the various movements provided by the actuator 90 can be effectuated by suitable servo means as in the previous cases. In other words, the servo means can be a hydraulic motor, a pneumatic system, or an electromechanical system.

In order to provide a charging appearance to the bull, an actuator can cause the bull to go up and down and move it in a rotational manner around the supporting pedestal member 28. In other words, the supporting upright 28 can be such that the bull 18 can pivot on the support in a rotational manner to provide angular orientation of the bull with respect to the arm 20. As will be described, certain movements of the bull are required in order to create a movement of the bull tantamount to a straight charge. As a consequence, rotational movement is imparted by actuator 98. The actuator 98 can also cause an upward and downward movement of the bull 18 on the upright support 28. The upward and downward movement, of course, creates a situation where the bull can rear or move in a manner consonant with the way a bull's body moves in a real life situation.

In addition to the foregoing movement, a tail actuator 100 is provided for movement of the tail so that it swishes as in a real life situation. The tail, of course, on a bull swishes when it is ready to charge.

As shown in greater detail in FIG. 6 the actuator 90, 98 and 100 orient the bull in both the vertical as well as horizontal mode. The actuators 90, 98 and 100 can also be of a type which will function in more than one axis. Each actuator 90, 98 and 100 can be substituted by two pairs of actuators which can each respectively move laterally and vertically.

Figure 7:
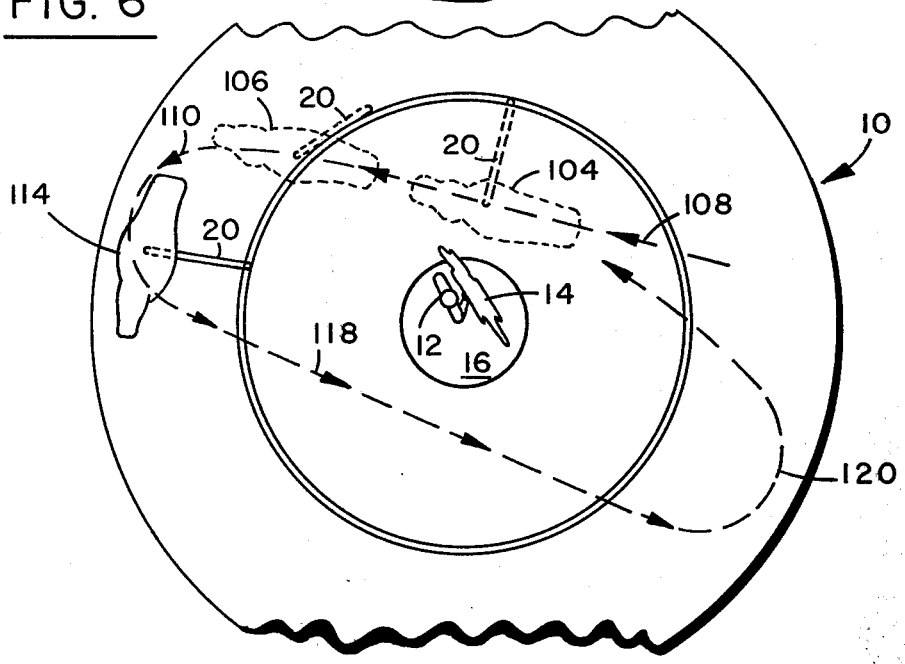
FIG. 7 shows a schematic plan view line diagram of a pre-established program for movement of the bull with respect to a participant; and, FIG. 8 shows a block diagram of the components of the system of this invention as incorporated in the major subsystem thereof.

The bull ring 10 is shown in a plan view in FIG. 7 wherein the bull 18 is making a pass; in this particular embodiment, the bull 18 has made a pass by the matador at station 104. As it passes by, the arm 20 is shown in a normal condition, or at a perpendicular to the longitudinal axis of the bull 18. As the bull 18 continues to move on the track 56 or 22, the angle of the arm 20 closes to an acute angle as seen at station 106. Thus, the bull 18 is provided with a relative motion that is generally in a straight line in the direction of arrow 108 until it begins to turn at arrow 110.

At arrow 110, the bull 18 is turned completely through the acute angle of the support 20 so that it is then in a perpendicular or normal orientation there as shown at station 114. In this orientation, the other side of the bull is exposed to the matador and the bull then makes the turn and charges in the direction of arrow 118 until it reaches another turn at the curved arrow 120.

It should be understood that the movement of the bull 18 with respect to the support arm 20 is effectuated and controlled by the actuator 98. This, of course, is controlled on a time and movement basis so that the angle of the bull 18 is such that it generally makes a pass at the matador on a looped basis.

Various angular orientations of the bull 18 with respect to the bar or support arm 20 can be provided. In other words, the angular orientation as it is changed provides different angles of attack and different modes so that the bull is not always attacking the matador at the same angle or mode. In other words, the stations at which the bull turns on the arm 20 can change with respect to the desired relative placement on the track 56. This allows for variable preestablished patterns to be effectuated by the computer so that the bull charges at what appears to be random points in the direction of the matador to simulate a real life situation.

Figure 8:
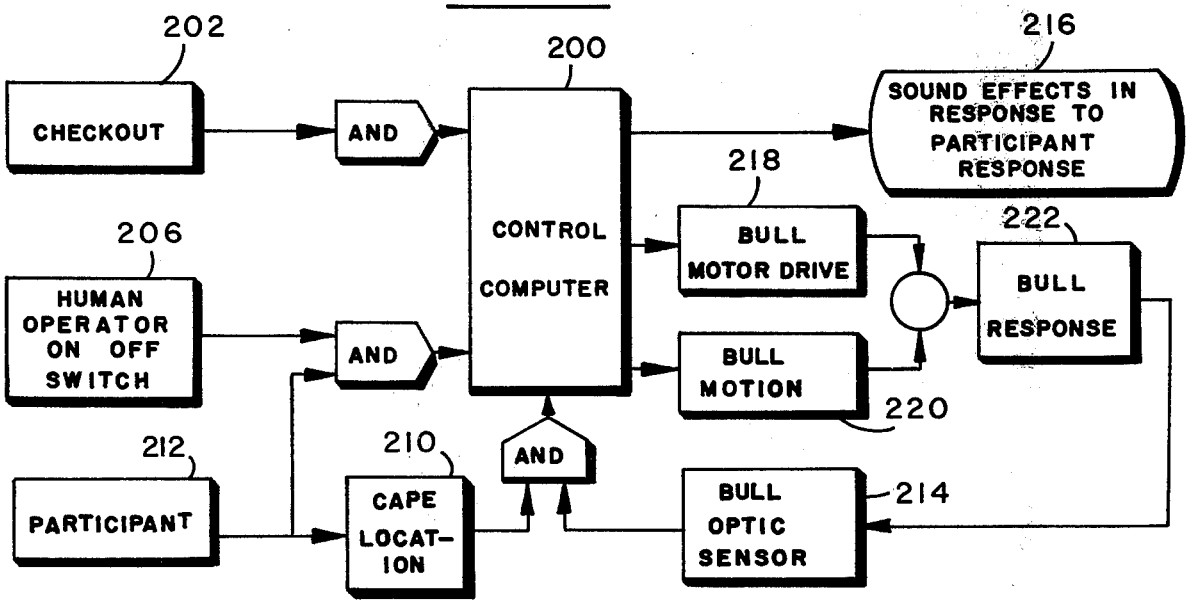

Looking more specifically at FIG. 8, the electrical and control configuration is substantially shown in a block diagram including the logic and the general flow thereof. As can be seen in FIG. 8, the different functions are generally controlled by a control computer 200. The control computer 200 is on line to control the various aspects and movements of the invention.

In operation, a participant pays a particular amount of money to begin the game to an operator or coin box. The participant then takes a matador's cape 14 into the ring. At this movement in time, due to a coin-operated device or other hand-operated switch means, the device then starts.

A checkout device 202 is provided to interface the entire operation and function of the invention with respect to either a coin-operated or manual operator-activated start function. The checkout device 202 also enables an override switch to create a situation wherein the checkout can allow the bull 18 to run without a participant for attraction purposes. In other words, in order to attract participants it is sometimes desirable to run the bull 18 on the track 22 in its different patterns without a participant in the ring. This can be accomplished by having a pre-established pattern for the bull and a charging motion applied to the bull through the control computer 200.

A human operator switch 206 is shown with an and gate going into the control computer. In this particular situation, the participant 12 stands on a plate 16 which is associated with the human operator switch 206. The human operator on-off switch 206 is a mechanical switch controlled by the participant's weight on the plate 16. In other words, when the participant steps off the plate 16 or disc into the ring 10, thereby being close to the bull 18 at the point where he might be hit, the entire device stops by means of an override to the control computer 200.

The participant 12 effectuates the location of the cape as indicated by box 210. In effect, function 210 is performed by an optical or physical contactor associated with the bull 18 and cape 14. The participant, with respect to the cape 14 and bull 18 location, places his body in a position which is also a function judged by the control computer 200. As a consequence, the participant's activity goes into the and gate associated with the human operator on-off switch 206 as well as the cape location function 210.

The cape location 210 is integrated with and matched to the bull's optic or mechanical sensor. The bull's optic sensor 214 is placed in the head of the bull to determine the position of the cape 14. When the two are matched in a fundamentally direct area, the and gate associates them to provide a positive signal to the control computer for purposes of eliciting sound effects through the sound effect medium 216. The sound effect medium can be such that an ole or a boo can be applied depending upon the location of the cape as it relates to the bull's optic sensor 214. In other words, when the cape is placed in a relatively obscure position, or is not laid in a proper manner over the bull's head 92, the sound effects will respond accordingly in the form of a boo. When the cape location of the bull's optic senses are directly on line to coordinate and effectuate a perfect pass of the cape, the control computer will match the two and create a sound effect such that there will be an ole.

In order to create the movement of the carriage, a bull motor drive in the form of a motor with adequate speed controls 218 is provided. The bull motor drive 218 is controlled by the computer and, of course, is overriden by the foregoing checkout 202 and human operator on-off switch 206 through the control computer 200. The bull motor drive 218 is generally provided on a constant speed basis. A bull motion means 220 effectuated by the control computer 200 causes a pre-programmed bull motion through the respective actuators 74, 76, 80, 90, 98 and 100. The foregoing actuators thereby create the bull's 18 response and it is shown in box 222. In addition thereto, the bull's response 222 can be varied by different means so as to provide a variable pattern depending upon the particular programming of the computer.

In addition to the foregoing apparatus and electronic instrumentation for causing the invention to actively operate, various other means can be utilized for causing the mechanical movement of the bull 18. Specifically, besides the foregoing technique, a telescoping technique can be utilized. The telescoping technique requires an outer ring which acts as the track or a rail which supports the bull. The bull is supported at its side and is placed at a distal relationship to the participant.

A telescoping shaft rides the outer rail and is projected inwardly and outwardly to provide the desired passes by the participant. In other words, the passes of the bull 18 are all provided on a controlled telescoping shaft that moves inwardly and outwardly. In addition thereto, the angular orientation with the track changes so that the bull comes toward the participant at different angular relationships.

In addition to the foregoing embodiment, a gear technique can be utilized in the form of a large precast gear or circumferential ring around the periphery of the bull ring. The precast gear can be sized properly to allow the bull to pass the participant in a predetermined pattern. In other words, the bull 18 can pass the participant inwardly and outwardly through a series of epicyclic trains which can be mounted in underlying relationship beneath the bull ring 10. In this manner, as the bull is passed from one epicyclic gear train to another, it can move in variable manners, depending upon how it is gated with respect to each series of gears as it moves through the epicyclic train.

Other mechanisms including an electric car technique and a remote control technique can be used in this instance. The electric car utilizes an energized surface either on the floor of the bull ring, the ceiling, or both, to supply power to the bull. Such methods are known in the utilization of bumper car rides. Thus, it provides the motion and also the power utilized for operation of the bull.

Other bull control and driving means can provide remote control of the bull on the tracks or other means can be used to guide the bull on a number of wheels. In other words, the bull can be attached to wheels or on a shaft which in turn moves the bull on a series of motive means such as the wheels with their own interior drives.

In any of the foregoing, it is generally desirable to provide a pre-established program either through an electromechanical system, or through a computer which can then cause the entire system to function in accordance with the movements desired to create a bull fighting game.

As can be understood from the foregoing alternative embodiments, this invention should be read broadly in light of the following claims, and should not be narrowed as to its scope and spirit.

I claim:

1. A simulated bull fight game comprising:

a simulated bull's figure;

a first support means for holding said simulated bull's figure;

an area in proximate relationship to said bull's figure adapted for a participant taking the part of a matador;

a cape for said participant;

optical sensor means in said bull to register the position of said cape in a participant's hand; and, means to move said bull on said support means with respect to said participant in a manner simulating the movement of a bull in a bull ring so that a participant can partake with a cape in a simulated bull fight.

2. The bull fight game as claimed in claim 1 further comprising;

said simulated bull's figure having actuators for moving a portion of its body relative to said support means.

3. The bull fight game as claimed in claim 1 further comprising:

an audio means for simulating audience response to a participant's activity with respect to the simulated bull's figure.

4. The bull fight game as claimed in claim 1 further comprising:

a bull ring having a circular track;

a carriage on a circular track, said carriage moves around the edge of the bull ring said carriage comprises said support means in part; and, a second support means that is attached to said carriage moves with respect to said carriage to move said figure in a separate path.

5. The bull fight game as claimed in claim 4 further comprising;

actuators for moving the head of said figure in a lateral as well as a vertical relationship;

actuators for moving the legs of said figures to provide an appearance of running;

an actuator for moving the tail of said figure to provide a swishing effect.

6. The bull fight game as claimed in claim 5 further comprising:

said track being an I-beam and, a carriage having rollers for underlying a transverse portion of the I beam.

7. The bull fight game as claimed in claim 1 further comprising:

a control computer for controlling the movement of said figure.

8. The bull fight game as claimed in claim 7 wherein:

said control computer has a series of programs for various figure movements associated therewith.

9. The bull fight game as claimed in claim 8 further comprising:

a participant area having an override switch which curtails the movement of the figure bull when a participant is not in said area.

10. The bull fight game as claimed in claim 9 wherein:

said override switch is a plate upon which a participant stands to activate the opertion of the bull fight game his weight.

11. The bull fight game as claimed in claim 10 further comprising:

a control override switch which can check the operation of the bull fight game through its various pre-established programs and provide an on and off function thereof.

12. The bull fight game as claimed in claim 1 further comprising:

said cape having interfacing electrical means for causing said optical sensor to read the position of the cape.

* * * * *